US006117514A

United States Patent [19]

Herrmann

[11] Patent Number: 6,117,514

[45] Date of Patent: Sep. 12, 2000

[54] CEILING TILE SYSTEM

[76] Inventor: Richard J. Herrmann, 312 N. Broadway, Watertown, S. Dak. 57201

[21] Appl. No.: 09/311,414

[22] Filed: May 13, 1999

[51] Int. Cl.[7] ..... B32B 3/06

[52] U.S. Cl. ..... 428/81; 428/177; 428/187

[58] Field of Search ..... 428/44, 81, 120, 428/177, 179, 180, 187; 52/506.1, 506.06, 506.08, 311.2, 316

*Primary Examiner*—Alexander Thomas

[57] ABSTRACT

A ceiling tile system for providing a light-weight and easy-to-form interlocking plastic ceiling tile system for covering a ceiling. The ceiling tile system includes at least on ceiling tile comprising a panel with front and back faces, and an outer perimeter comprising a plurality of alternating side edges and corners. Each of the corners of the panel has a corner tab. Each of the side edges of the outer perimeter of the panel has an associated side ridge extending there-adjacent between adjacent corners tabs between which the respective side edge is interposed. The side ridges outwardly extend from the front face of the panel and the side ridges form a plurality of corresponding side grooves in the back face of the panel. Each of the side ridges of the panel is designed for insertion into a side groove of an adjacent side edge of a second panel placed over the side ridge such that the adjacent corner tabs of the second panel are placed over the adjacent corner tabs of the panel.

10 Claims, 4 Drawing Sheets

CEILING TILE SYSTEM

BACKGROUND OF THE INVENTION

1. Field of the Invention

The present invention relates to ceiling tiles and more particularly pertains to a new ceiling tile system for providing a light-weight and easy-to-form interlocking plastic ceiling tile system for covering a ceiling.

2. Description of the Prior Art

The use of ceiling tiles is known in the prior art. More specifically, ceiling tiles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,69,063 by Lewis; U.S. Pat. No. 3,991,529 by Terwilliger; U.S. Pat. No. Des. 365,160 by Tinen; U.S. Pat. No. 4,617,210 by Zybko; U.S. Pat. No. 4,695,493 by Friedlander et al.; U.S. Pat. No. 4,195,107 by Timm; U.S. Pat. No. Des. 189,297 by Froberg; U.S. Pat. No. Des. 183,256 by Green; U.S. Pat. No. Des. 159,208 by Hyman; and U.S. Pat. No. Des. 156,170 by Romanelli.

Typically, prior art ceiling tiles have perimeter edges (oriented perpendicular to the face of the tile) which are provided with tongue and groove structures for interconnecting the tiles when installed on a ceiling. To form the tongue and groove structures, the ceiling tiles are relatively thick (usually at least ¼ inch and thicker) for providing a sufficient edge width perpendicular to the face of the tile for the tongue and groove interconnection structures. Even though many of the prior art tiles are formed from relatively lightweight fibrous materials, the relatively thick structure of the tiles adds greatly to the bulk and weight of the tile. The significant weight and bulk of the tiles require relatively strong attachment systems for attaching the tiles to a ceiling structure and in many cases the use of individual fasteners to hang the tiles. Typical attachment structures include furring strips with individual fasteners, track and clip systems, and high strength adhesives applied to the tile just before installation. These attachment systems require additional time for installation, and add significant material expense on top of the cost of the tiles.

In these respects, the ceiling tile system according to the present invention substantially departs from the conventional concepts and designs of the prior art, and in so doing provides an apparatus primarily developed for the purpose of providing a light-weight and easy-to-form interlocking plastic ceiling tile system for covering a ceiling.

SUMMARY OF THE INVENTION

In view of the foregoing disadvantages inherent in the known types of ceiling tiles now present in the prior art, the present invention provides a new ceiling tile system construction wherein the same can be utilized for providing a light-weight and easy-to-form interlocking plastic ceiling tile system for covering a ceiling.

The general purpose of the present invention, which will be described subsequently in greater detail, is to provide a new ceiling tile system apparatus and method which has many of the advantages of the ceiling tiles mentioned heretofore and many novel features that result in a new ceiling tile system which is not anticipated, rendered obvious, suggested, or even implied by any of the prior art ceiling tiles, either alone or in any combination thereof.

To attain this, the present invention generally comprises at least one ceiling tile comprising a panel with front and back faces, and an outer perimeter comprising a plurality of alternating side edges and corners. Each of the corners of the panel has a corner tab. Each of the side edges of the outer perimeter of the panel has an associated side ridge extending adjacent to the side edge, and the side ridge extends between adjacent corners tabs located at each end of the respective side edge. The side ridges extend outwardly from the front face of the panel and the side ridges form a plurality of corresponding side grooves in the back face of the panel. Each of the side ridges of the panel is designed for insertion into a side groove of an adjacent side edge of a second panel placed over the side ridge such that the adjacent corner tabs of the second panel are placed over the adjacent corner tabs of the panel. The ceiling tiles of the invention is most preferably formed of an very thin material for producing an extremely lightweight tile that can be attached to a ceiling structure without attachment methods that are complex and add expense to a ceiling tile installation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new ceiling tile system which is of a durable and reliable construction.

A further object of the present invention is to provide a new ceiling tile system which is susceptible of a low cost of manufacture and installation with regard to both materials and labor, and which accordingly is then susceptible of low prices of sale to the consuming public, thereby making such ceiling tile system economically available to the buying public.

Another object of the present invention is to provide a new ceiling tile system for providing lightweight and easy-to-form interlocking plastic ceiling tiles for covering a ceiling.

Yet another object of the present invention is to provide a new ceiling tile system which includes at least one ceiling tile comprising a panel with front and back faces, and an outer perimeter comprising a plurality of alternating side edges and corners. Each of the corners of the panel has a corner tab. Each of the side edges of the outer perimeter of the panel has an associated side ridge extending adjacent to the side edge, and the side ridge extends between adjacent corners tabs located at each end of the respective side edge. The side ridges extend outwardly from the front face of the panel and the side ridges form a plurality of corresponding side grooves in the back face of the panel. Each of the side ridges of the panel is designed for insertion into a side groove of an adjacent side edge of a second panel placed over the side ridge such that the adjacent corner tabs of the second panel are placed over the adjacent corner tabs of the panel.

Still yet another object of the present invention is to provide a new ceiling tile system that is of such lightweight structure that the ceiling tile may be adhesively attached to a ceiling with, for example, a double-sided tape attached to the back face of the ceiling tile or a spray applied adhesive.

Even still another object of the present invention is to provide a new ceiling tile that is most preferably made by thermal vacuum forming of plastic sheeting material so that a plurality of ceiling tiles may be quickly and easily manufactured in a repeated fashion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
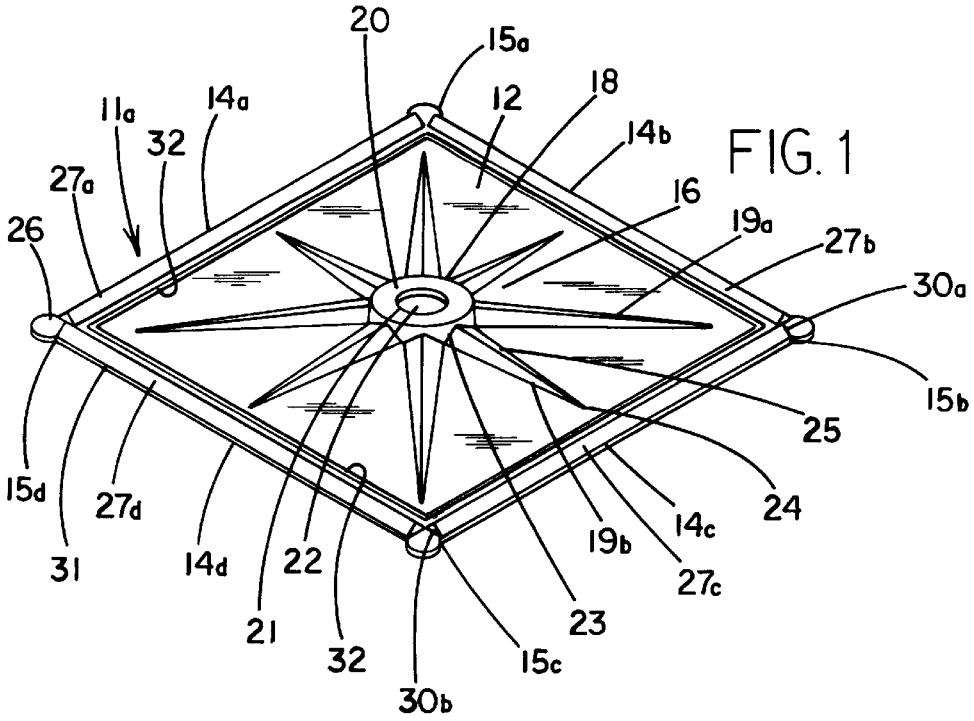
FIG. 1 is a schematic perspective view of the front face of a new ceiling tile.
Figure 2:
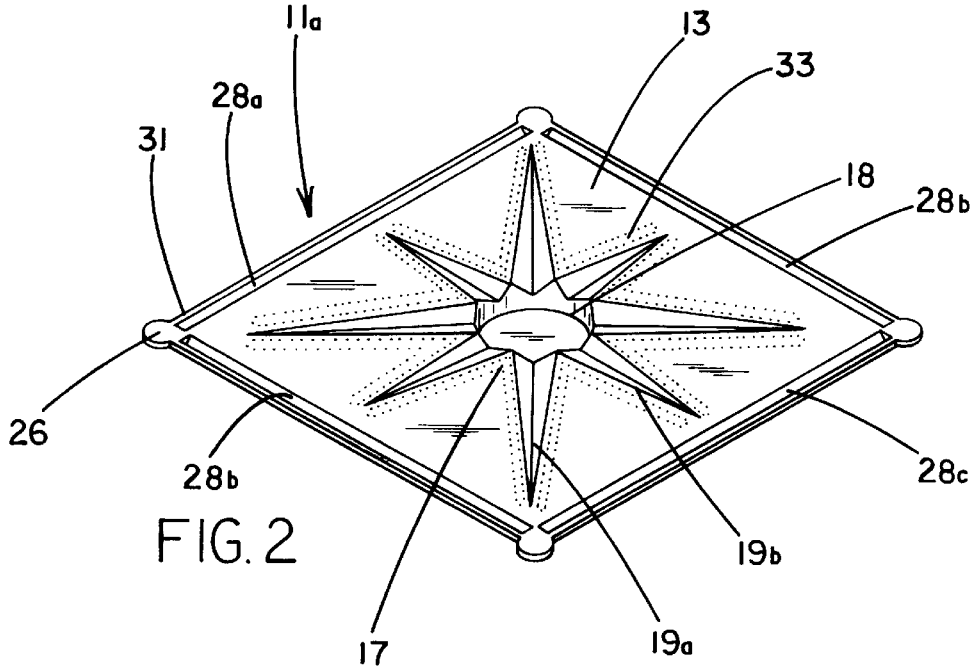
FIG. 2 is a schematic perspective view of the back face of a ceiling tile.
Figure 3:
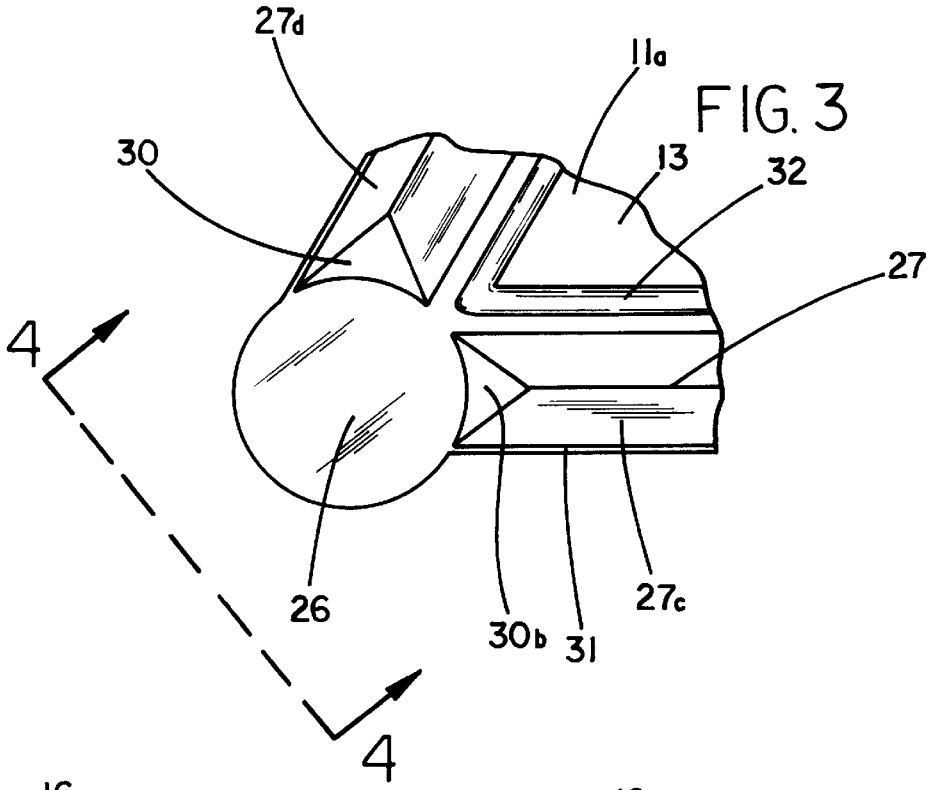
FIG. 3 is a schematic enlarged partial plan view of the front face of the panel detailing a corner of the panel.

With reference now to the drawings, and in particular to FIGS. 1 through 7 thereof, a new ceiling tile system embodying the principles and concepts of the present invention will be described.

As best illustrated in FIGS. 1 through 7, the ceiling tile system generally comprises at least one ceiling tile comprising a panel with front and back faces, and an outer perimeter comprising a plurality of alternating side edges and corners. Each of the corners of the panel has a corner tab. Each of the side edges of the outer perimeter of the panel has an associated side ridge extending adjacent to the side edge, and the side ridge extends between adjacent corners tabs located at each end of the respective side edge. The side ridges extend outwardly from the front face of the panel and the side ridges form a plurality of corresponding side grooves in the back face of the panel. Each of the side ridges of the panel is designed for insertion into a side groove of an adjacent side edge of a second panel placed over the side ridge such that the adjacent corner tabs of the second panel are placed over the adjacent corner tabs of the panel.

In closer detail, the interlocking ceiling tile system is designed for mounting to a ceiling structure to cover the ceiling structure to provide a lightweight decorative ceiling surface. The system comprises at least one ceiling tile comprising a panel 11*a*, 11*b*, 11*c*, 11*d* having a center, front and back faces 12, 13. An outer perimeter of the ceiling tile comprises a plurality of alternating side edges 14*a*, 14*b*, 14*c*, 14*d* and corners 15*a*, 15*b*, 15*c*, 15*d*.

In a preferred embodiment, the outer perimeter of the panel is generally square such that the plurality of side edges of the panel comprises four side edges of substantially equal length and the plurality of corners comprises four corners. The panel has a length defined between a substantially parallel first opposite pair of side edges of the outer perimeter of the panel and a width defined between a substantially parallel second opposite pair of side edges of the outer perimeter of the side panel extending substantially perpendicular to the first opposite pair of side edges. In an ideal illustrative embodiment of the preferred embodiment, the length and width of the panel are substantially equal to one another and are each about 12 inches.

Ideally, the panel is thermal vacuumed formed so that the front face of the panel has a raised relief 16 upwardly extending therefrom, the back face of the panel has a depression 17 corresponding to the shape of the relief of the front face of the panel. In use, the relief is designed for enhancing the overall rigidity of the panel to minimize flexing, bending, and buckling of the panel so that the panel remains generally flat and unbuckled, especially after installation on a ceiling. Ideally, at least a portion of the relief takes the form of a decorative pattern for providing decorative enhancement to the front face of the ceiling tile for the enjoyment of a viewer of the ceiling tile.

In the preferred embodiment, the relief is generally star-shaped and comprises a generally cylindrical center extent 18 concentric with the center of the panel, and a plurality of points 19*a*, 19*b* outwardly radiating from the center extent of the relief and thus the center of the panel.

The center extent of the relief has a generally circular outer face 20 lying in a plane substantially parallel to the front face of the panel. The center extent of the relief also preferably has a generally circular center depression 21 in the outer face of the center extent. The center depression is concentric with the center of the panel and has an inner face 22 lying in a plane interposed between and substantially parallel with the outer face of the center extent and the front face of the panel.

In an ideal illustrative embodiment, the center extent has an elevation defined between the front face of the panel and the outer face of the center extent of about ¾ inch so that the points help provide an ideal rigidity to the panel. In such an ideal illustrative embodiment, the outer face of the center extent has an outer diameter of about 2.692 inches and an inner diameter defined across the outer periphery of the center depression of about 1.5 inches.

The points of the relief each have a root 23 adjacent the center extent of the relief and a pointed tip 24 opposite the root of the respective point and positioned towards the outer perimeter of the panel. Each of the points of the relief has an inverted generally V-shaped transverse cross section (taken a plane substantially perpendicular to the plane of the front face of the panel) to define a substantially straight upper ridge 25 or peak line extending between the root and tip of the respective point.

Figure 4:
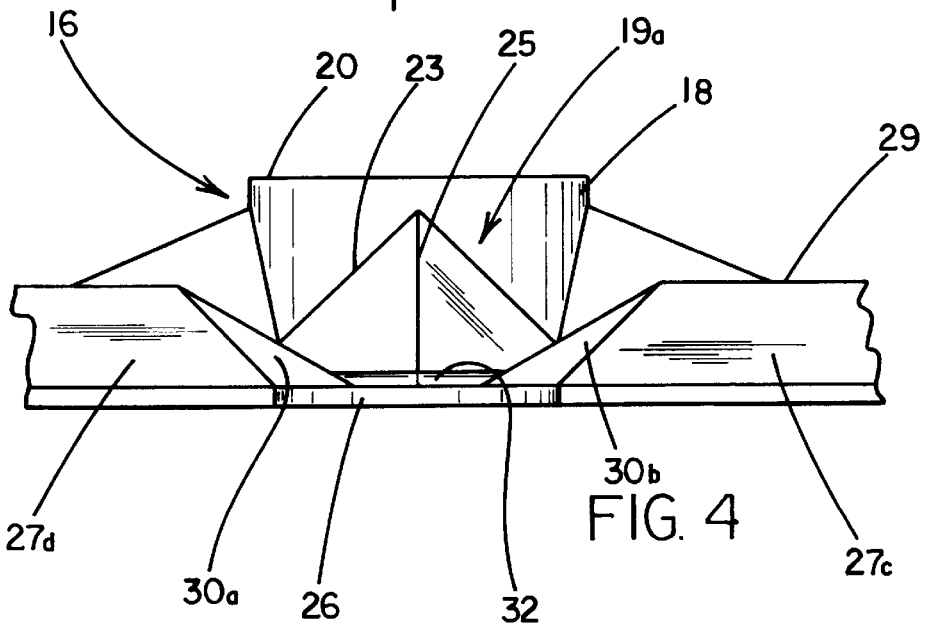
FIG. 4 is a schematic side view of the corner illustrated in FIG. 3 as seen from the vantage of line 4—4 of FIG. 3.

The upper ridge of each of the points slopes outwardly from the front face of the panel in a direction from the tip to the root of the respective point. Portions of the upper ridges of the points located at the roots of the points lie in a common plane with one another positioned between and substantially parallel with the plane of the outer face of the center extent and the plane of the front face of the panel. This common plane is spaced apart from the plane of the outer face of the center extent as best illustrated in FIG. 4.

The points each have a length defined between the root and tip of the respective point. Preferably, the plurality of points comprises alternating long points 19*a* and short points 19*b*. The long points are extended towards corners of the outer perimeter of the panel and the short points are extended towards the side edges of the outer perimeter of the panel. The long points has substantially equal lengths and the short points has substantially equal lengths with the lengths of the long points being greater than the lengths of the short points.

In use, the points and especially the upper ridges of the points are designed for helping to enhance the rigidity of the panel to help resist undesirable flexing, bending and buckling of the panel. While the design of the relief of the preferred embodiment described above is especially well suited for providing enhanced rigidity to the panel, other designs may be used for the relief in the panel without departing from the invention.

Each of the corners of the panel has a generally circular flat corner tab 26 outwardly extending therefrom. The corner tabs are coplanar with the front and back faces of the panel. In the ideal illustrative embodiment, the corner tabs each have an outer diameter of about 0.707 inches The front face of the panel has a plurality of elongate side ridges 27*a*, 27*b*, 27*c*, 27*d* extending outwardly from the front face, and the ridges form a plurality of corresponding side grooves 28*a*, 28*b*, 28*c*, 28*d* in the back face of the panel. Each of the side edges of the outer perimeter of the panel has an associated side ridge extending thereadjacent between adjacent corners tabs between which the respective side edge is interposed such that the each side ridge is extended substantially parallel to the adjacent respective side edge.

Figure 7:
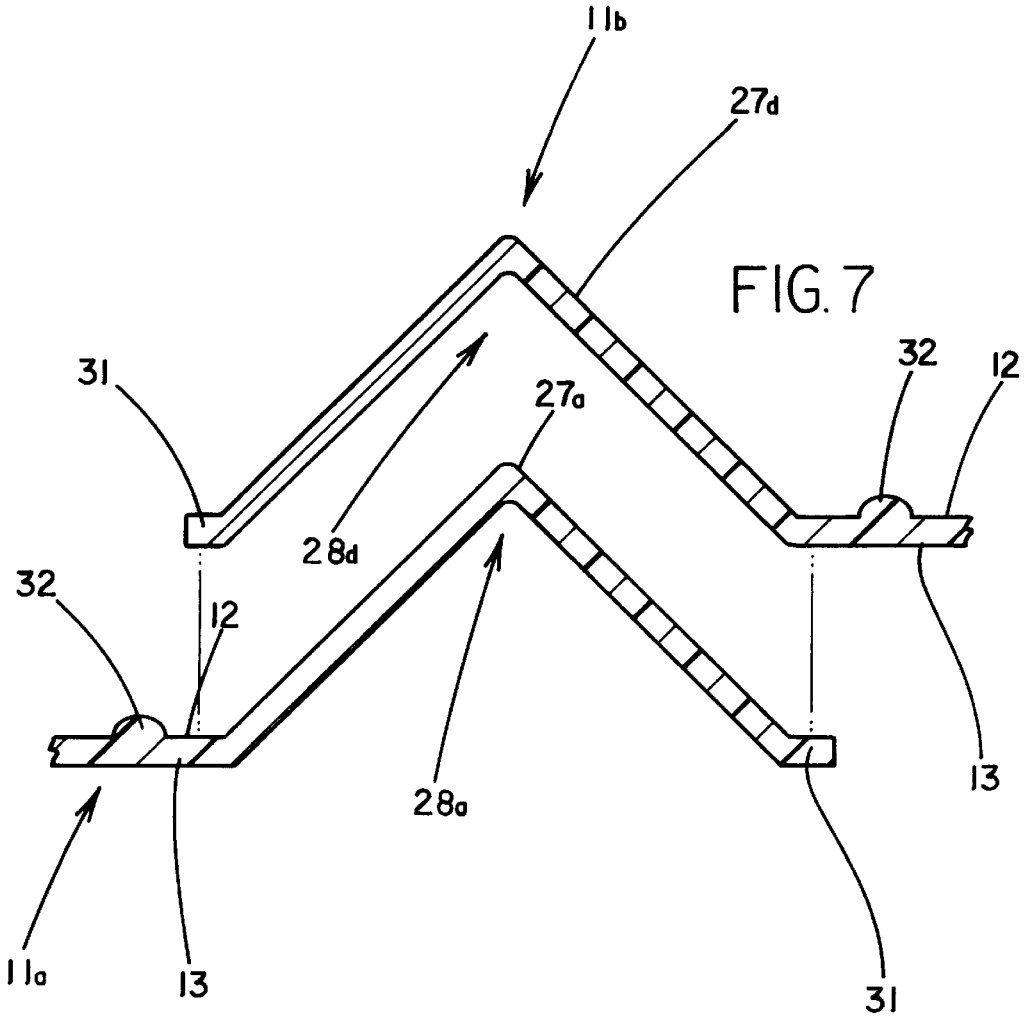
FIG. 7 is a schematic exploded cross sectional view taken from line 7—7 of FIG. 6 illustrating the interlocking relationship between a side groove and side ridge of adjacent interlocked ceiling tiles of the invention.

As best illustrated in FIG. 7, each of the side ridges has an inverted generally V-shaped transverse cross section forming an elongate outer ridge line 29 along the respective side edge. Correspondingly, each of the side grooves has a generally V-shaped transverse cross section corresponding with the associated side ridge. Ideally, the side ridges each have an elevation defined between the front face of the panel and the outer ridge line of the respective side ridge of about ¼ inch, and each of the side ridges has a transverse width of about ½ inch.

Each of the side ridges has a pair of opposite inclined ends 31*a*, 31*b*. One of the inclined ends of each side ridge is positioned adjacent one of the corner tabs located adjacent the respective side ridge and the other of the inclined ends of each side ridge is positioned adjacent the other of the corner tabs located adjacent the respective side ridge. The inclined ends each have a concave outer face facing generally in a direction towards the associated adjacent corner tab. As best illustrated in FIG. 4, the inclined ends of each side ridge slope from the associated adjacent corner tab and the outer ridge line of the respective side ridge. Ideally, the slope of each inclined end defined from the front face of the panel is about 45 degrees.

In use, with reference to FIG. 7, the side ridges of the panel each are designed for insertion into a side groove of an adjacent side edge of a second panel placed over and thereby overlap the side ridge such that the adjacent corner tabs of the second panel are placed on top of the adjacent corner tabs of the panel.

The panel has a coplanar elongate edge portion 31 interposed between each side edge and the adjacent associated side ridge. The panel also preferably has a plurality of elongate guide ridges 32 outwardly extending from the front face of the panel. Each of the guide ridges is extended substantially parallel to an adjacent associated side edge such that the adjacent side ridge associated therewith is interposed between the respective guide ridge and the associated side edge and each guide ridge is spaced apart from the adjacent associated side ridge. As best illustrated in FIG. 7, the guide ridges each have an arcuate transverse cross section has a convexity outwardly facing from the front face of the panel.

Significantly, the grooves and ridges formed on the front and back faces of the panels permit interlocking of the tiles without requiring a significant thickness of the panel that would be required if interlocking structures were formed on the edge of the tile. The interlocking grooves and ridges permit the panel to be formed from an extremely thin material that produces an extremely lightweight tile. The extreme thinness of the panel permits forming of the panel from a thin and lightweight material, which is most preferably a plastic sheet material, although other sheet materials may be used. A plastic material is highly preferred because the relief of the tile may be formed in the panel by thermal vacuum form methods. This preferred material and method of material forming produces very inexpensive tiles.

The extreme thin and lightweight character of the resulting tile makes it easily handled during installation, and easily and simply attached to a ceiling structure. The lightweight character of the tile permits the tile to be attached to the ceiling by an adhesive without any use of mechanical fasteners. The back face of the panel is designed for attachment to a surface. Preferably, the back face of the panel has an adhesive provided thereon for adhesively attaching the back face of the panel to the surface. In one preferred embodiment, the adhesive is sprayed on to the back face of the panel just prior to mounting the tile to the surface. In another highly preferred embodiment, the back face of the panel has a plurality of double sided elongate adhesive strips 33 each having a pair of opposite sides with adhesive provided thereon. One adhesive side is adhesively attached to the back face of the panel and the other adhesive side is adhesively attachable to the surface. (Ideally, the side of the strip intended for attachment to the ceiling is provided with a releasable backing strip that may be peeled away from the adhesive strip just prior to attachment of the tile to the ceiling surface.) The adhesive strips are attached to the back face along an outer periphery of the points as illustrated in FIG. 1 in broken lines.

Figure 5:
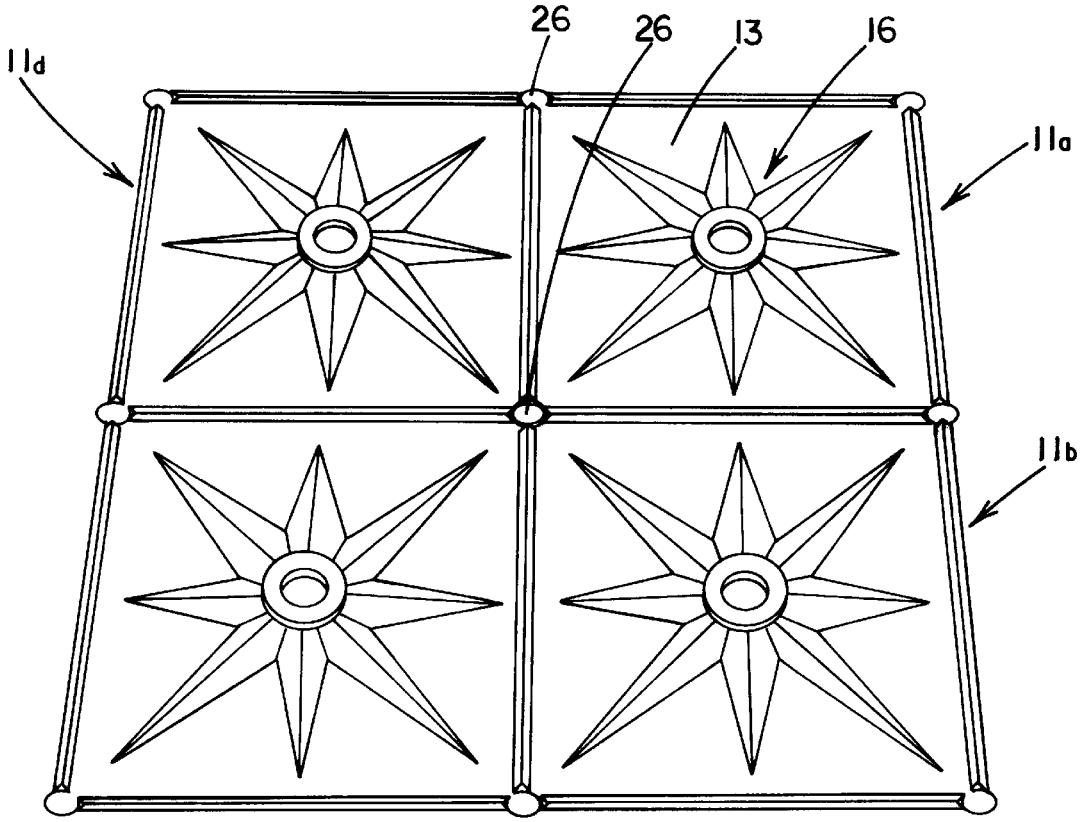
FIG. 5 is a schematic front perspective view of four interlocking ceiling tiles of the present invention.
Figure 6:
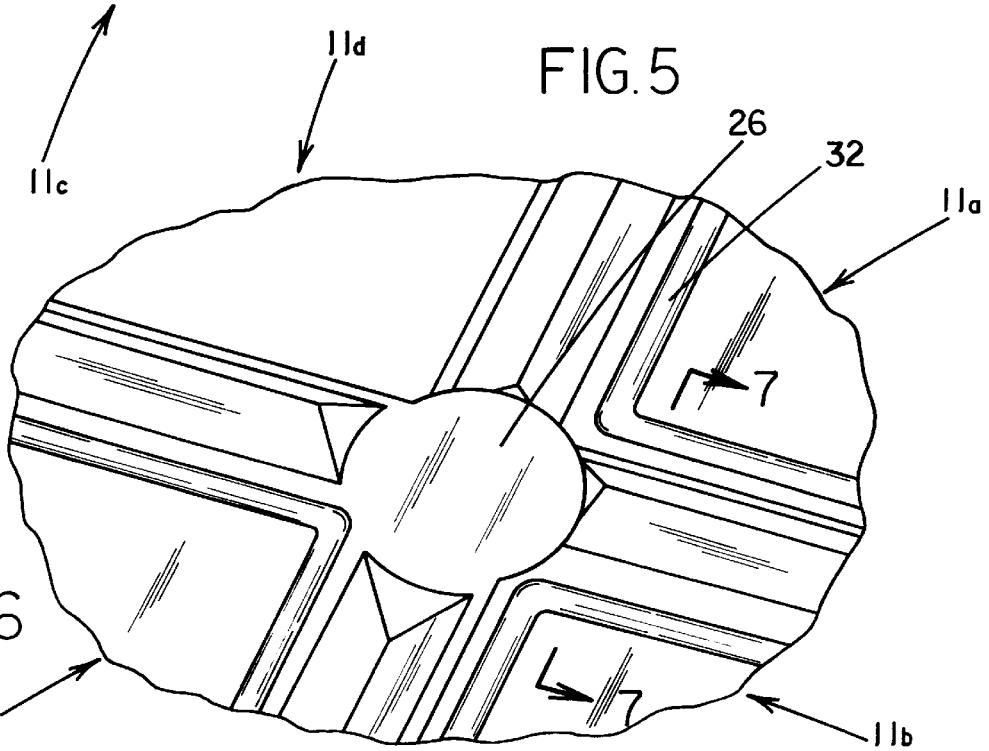
FIG. 6 is a schematic enlarged perspective view of the overlapping corners in the center of the four ceiling tiles illustrated in FIG. 5.

In use, the panels are designed for mounting to a ceiling surface such that the side grooves and side ridges of overlapping ceiling tiles interlock with the corner tabs overlapping each other. As illustrated in FIG. 5 through 7, a first side ridge of a first panel is inserted into a first side groove of an adjacent side of a second panel positioned adjacent the first panel such that one of the corner tabs of the second panel adjacent the first side groove is positioned on top of one of the corner tabs of the first panel positioned adjacent the first side ridge and the other of the corner tabs of the second panel adjacent the first side groove is positioned on top of the other of the corner tabs of the first panel positioned adjacent the first side ridge. This relationship interlocks the first and second panels together along their adjacently positioned side edges. A first edge portion of the second panel adjacent the first side groove is positioned between the first side ridge of the first panel and a first guide ridge of the first panel positioned adjacent the first side ridge to help keep the first side groove and side ridge interlocked with one another and to help provide a finished seam between the two panels. The panel of the next adjacent ceiling tile is placed adjacent the second panel such that a side groove of this third panel receives a side ridge of the second panel adjacent extending perpendicular to the interlocked side edges of the first and second panel. This way the corner tabs of four adjacent interlocked panels may overlap each other as best shown in FIG. 6. The user may place their thumb or finger on the overlapped corner tabs to secure the interlocking side groove and side ridges. The corner tabs may also be used as a place to grasp a panel to separate interlocking panels. The front faces of the interlocking panels may then be painted over to finish the ceiling covered with the panels.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An interlocking ceiling tile comprising:

a panel having a center, front and back faces, and an outer perimeter comprising a plurality of alternating side edges and corners;

each of said corners of said panel having a corner tab;

each of said side edges of said outer perimeter of said panel having an-associated side ridge extending there-adjacent between adjacent corners tabs between which the respective side edge is interposed;

said side ridges outwardly extending from said front face of said panel, said side ridges forming a plurality of corresponding side grooves in said back face of said panel; and each of said side ridges of said panel being adapted for insertion into a side groove of an adjacent side edge of a second panel placed over said side ridge such that the adjacent corner tabs of said second panel are placed over the adjacent corner tabs of said panel.

2. The ceiling tile of claim 1, wherein said outer perimeter of said panel is generally square such that said plurality of side edges of said panel comprises four side edges of substantially equal length and said plurality of corners comprises four corners.

3. The ceiling tile of claim 1, wherein said front face of said panel has a raised relief upwardly extending therefrom, said back face of said panel having a depression corresponding to the shape of said relief of said front face of said panel.

4. The ceiling tile of claim 3, wherein said relief comprises a center extent at said center of said panel, and a plurality of points outwardly radiating from said center extent of said relief.

5. The ceiling tile of claim 4, wherein said center extent of said relief has a generally circular outer face lying in a plane substantially parallel to said front face of said panel, wherein said center extent of said relief has a generally circular center depression in said outer face of said center extent, and wherein said center depression is concentric with said center of said panel and having an inner face lying in a plane interposed between and substantially parallel with said outer face of said center extent and said front face of said panel.

6. The ceiling tile of claim 4, wherein said points of said relief each have a root adjacent said center extent of said relief and a pointed tip opposite said root of the respective point and positioned towards said outer perimeter of said panel, and wherein each of said points of said relief has a generally V-shaped transverse cross section defining a substantially straight upper ridge extending between said root and tip of the respective point.

7. The ceiling tile of claim 1, wherein each of said side ridges has a pair of opposite inclined ends, one of said inclined ends of each side ridge being positioned adjacent one of the corner tabs located adjacent the respective side ridge and the other of said inclined ends of each side ridge being positioned adjacent the other of the corner tabs located adjacent the respective side ridge.

8. The ceiling tile of claim 7, wherein said inclined ends each have a concave outer face.

9. The ceiling tile of claim 1, wherein said panel has a coplanar elongate edge portion interposed between each side edge and the adjacent associated side ridge, and wherein said panel having a plurality of elongate guide ridges outwardly extending from said front face of said panel, each of said guide ridges being extended substantially parallel to an adjacent associated side edge such that the adjacent side ridge associated therewith is interposed between the respective guide ridge and the associated side edge and each guide ridge is spaced apart from the adjacent associated side ridge.

10. An interlocking ceiling tile system adapted for mounting to a ceiling structure, comprising at least one ceiling tile comprising:

a panel having a center, front and back faces, and an outer perimeter comprising a plurality of alternating side edges and corners;

wherein said outer perimeter of said panel is generally square such that said plurality of side edges of said panel comprises four side edges of substantially equal length and said plurality of corners comprises four corners;

said front face of said panel having a raised relief upwardly extending therefrom, said back face of said panel having a depression corresponding to the shape of said relief of said front face of said panel;

said relief being generally star-shaped and comprising a generally cylindrical center extent concentric with said center of said panel, and a plurality of points outwardly radiating from said center extent of said relief;

said center extent of said relief having a generally circular outer face lying in a plane substantially parallel to said front face of said panel;

said center extent of said relief having a generally circular center depression in said outer face of said center extent, said center depression being concentric with said center of said panel and having an inner face lying in a plane interposed between and substantially parallel with said outer face of said center extent and said front face of said panel;

said points of said relief each having a root adjacent said center extent of said relief and a pointed tip opposite said root of the respective point and positioned towards said outer perimeter of said panel;

each of said points of said relief having a generally V-shaped transverse cross section defining a substantially straight upper ridge extending between said root and tip of the respective point;

said upper ridge of each of said points sloping outwardly from said front face of said panel in a direction from said tip to said root of the respective point;

portions of said upper ridges of said points located at said roots of said points lying in a common plane with one another positioned between and substantially parallel with said plane of said outer face of said center extent and said plane of said front face of said panel, said common plane being spaced apart from said plane of said outer face of said center extent;

each of said corners of said panel having a generally circular corner tab outwardly extending therefrom, said corner tabs being coplanar with said panel;

said front face of said panel having a plurality of elongate side ridges outwardly extending therefrom, said side ridges forming a plurality of corresponding side grooves in said back face of said panel;

each of said side edges of said outer perimeter of said panel having an associated side ridge extending there-adjacent between adjacent corners tabs between which the respective side edge is interposed such that said each side ridge is extended substantially parallel to the adjacent respective side edge;

each of said side ridges having a generally V-shaped transverse cross section forming an elongate outer ridge line along the respective side edge and each of said side grooves having a generally V-shaped transverse cross section corresponding with the associated side ridge;

each of said side ridges having a pair of opposite inclined ends;

one of said inclined ends of each side ridge being positioned adjacent one of the corner tabs located adjacent the respective side ridge and the other of said inclined ends of each side ridge being positioned adjacent the other of the corner tabs located adjacent the respective side ridge;

said inclined ends of each side ridge sloping from the associated adjacent corner tab and the outer ridge line of the respective side ridge;

said inclined ends each having a concave outer face;

said side ridges of said panel each being adapted for insertion into a side groove of an adjacent side edge of a second panel placed over said side ridge such that the adjacent corner tabs of said second panel are placed on top of the adjacent corner tabs of said panel;

said panel having a coplanar elongate edge portion interposed between each side edge and the adjacent associated side ridge;

said panel having a plurality of elongate guide ridges outwardly extending from said front face of said panel, each of said guide ridges being extended substantially parallel to an adjacent associated side edge such that the adjacent side ridge associated therewith is interposed between the respective guide ridge and the associated side edge and each guide ridge is spaced apart from the adjacent associated side ridge;

said guide ridges each having an arcuate transverse cross section having a convexity outwardly facing from said front face of said panel;

wherein said back face of said panel being adapted for attachment to a surface;

wherein a first side ridge of a first panel is inserted into a first side groove of an adjacent side of a second panel positioned adjacent said first panel such that one of said corner tabs of said second panel adjacent said first side groove is positioned on top of one of said corner tabs of said first panel positioned adjacent said first side ridge and the other of said corner tabs of said second panel adjacent said first side groove is positioned on top of the other of said corner tabs of said first panel positioned adjacent said first side ridge; and a first edge portion of said second panel adjacent said first side groove being positioned between said first side ridge of said first panel and a first guide ridge of said first panel positioned adjacent said first side ridge.

* * * * *